US005726667A

United States Patent [19]

Tamura

[11] Patent Number: 5,726,667

[45] Date of Patent: Mar. 10, 1998

[54] PORTABLE COMMUNICATION SYSTEM

[75] Inventor: Masahiro Tamura, Kawasaki, Japan

[73] Assignee: Fujitsu Limited, Kawasaki, Japan

[21] Appl. No.: 677,456

[22] Filed: Jul. 2, 1996

Related U.S. Application Data

[62] Division of Ser. No. 278,818, Jul. 22, 1994, Pat. No. 5,563,618.

[30] Foreign Application Priority Data

Jan. 31, 1994 [JP] Japan ..... 6-009293

[51] Int. Cl.[6] ..... H01Q 13/00

[52] U.S. Cl. ..... 343/786; 343/772; 343/906; 455/130

[58] Field of Search ..... 343/786, 906, 343/784, 772, 776; 455/130, 150; 439/916; H01Q 13/00, 13/02

[56] References Cited

U.S. PATENT DOCUMENTS 4,058,813 11/1977 Risko ..... 343/786

4,072,899 2/1978 Shimp ..... 325/67

5,109,232 4/1992 Monte ..... 343/786

5,563,618 10/1996 Tamura ..... 343/786

*Primary Examiner*—Hoanganh T. Lee

*Attorney, Agent, or Firm*—Armstrong, Westerman, Hattori, McLeland & Naughton

[57] ABSTRACT

A portable communication device which has a horn antenna and a transmitter-receiver and in which the horn antenna can readily be attached to and detached from the transmitter-receiver in a short time. In this portable communication device, a flange on the horn antenna side is connected to a flange on the transmitter-receiver side with four clasps etc. The four clasps etc. are arranged at equal intervals around the outer periphery of the interface of a connecting portion. The clasp comprises a fixing hook portion and a pushing-down portion. The fixed hook portion and the pushing-down portion are fixed to the flanges on the transmitter-receiver side and on the horn antenna side, respectively. The clasps etc. can be operated very easily with a single motion. Therefore, the horn antenna can be attached to and detached from the transmitter-receiver in a short time without a tool. Also, this attaching/detaching operation can reliably be performed in the dark without lighting.

10 Claims, 9 Drawing Sheets

PORTABLE COMMUNICATION SYSTEM

This is a divisional of application Ser. No. 08/278,818 filed Jul. 22, 1994, now U.S. Pat. No. 5,563,618.

BACKGROUND OF THE INVENTION (1) Field of the Invention

The present invention relates to a portable communication device having a horn antenna and a transmitter-receiver and, more particularly to a portable communication device in which the horn antenna and the transmitter-receiver are transported separately and assembled for use at the site.

(2) Description of the Related Art

In recent years, digital satellite communications systems have been widely used in various fields. For instance, they have been widely used as effective communication means by news media because the systems can rapidly send information from a news spot, to which communication line does not reach, by using a communications satellite. For such purposes, a portable communication device constructed available for portability is commonly used.

This communication device is comprised of a horn antenna and a transmitter-receiver. If the device is transported with the horn antenna and the transmitter-receiver being connected, the connecting portion, which is subjected to an excessive load of weight, may be damaged. Therefore, the horn antenna and the transmitter-receiver are transported separately and assembled for use at the site. In assembling the horn antenna and the transmitter-receiver, bolts are generally used for joining them.

However, when the horn antenna and the transmitter-receiver are joined with bolts, the thread ridges of the housing receiving the bolts may be damaged after the attachment and detachment of bolts are repeated frequently. Once the thread ridges are damaged, the joining becomes impossible. This tendency is more pronounced because the transmitter-receiver is often made of aluminum to decrease the weight.

In addition, the attachment and removal of bolts take much time and require a tool. Also, it is difficult to attach or remove the bolts by groping in the dark. These problems are especially serious when the communication device is used for news media requiring urgency.

With the portable communication device in which the horn antenna and the transmitter-receiver are connected to each other, if transmission is carried out with no horn antenna being connected, the transmitted signal is reflected by the connecting portion and returned to the transmitter because the connecting portion is open. The returned signal will destroy the transistor of the final stage amplifier in the transmitter. To prevent such a trouble, therefore, it is necessary to inform an operator of the portable communication device beforehand of the fact that the horn antenna has not been mounted.

When a communication device is used by connecting the horn antenna to the transmitter-receiver, it is difficult to ensure airtightness at the connecting portion. In particular, in the portable communication device described above, which is used under various climate conditions, external humid air and moisture are prone to enter through the connecting portion. If humid air enters the inside of the transmitter-receiver, a trouble may be caused in transmitting and receiving signals or may result in a failure. Therefore, the airtightness at the connecting portion is one of the serious problems.

SUMMARY OF THE INVENTION

An object of the present invention is to provide a portable communication device in which a horn antenna and a transmitter-receiver can readily be attached and detached in a short time.

Further, a second object of the present invention is to provide a portable communication device in which a failure caused by failing in mounting the horn antenna can be prevented.

Still further, a third object of the present invention is to provide a portable communication device in which airtightness can be ensured under various climate conditions.

To achieve the above objects, the present invention provides a portable communication device having a horn antenna and a transmitter-receiver. This portable communication device comprises a connecting portion provided between the horn antenna and the transmitter-receiver and single-motion attaching/detaching means for attaching and detaching the horn antenna to and from the transmitter-receiver with a single motion.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENT

An embodiment of the present invention will be described below with reference to the drawings.

Figure 1:
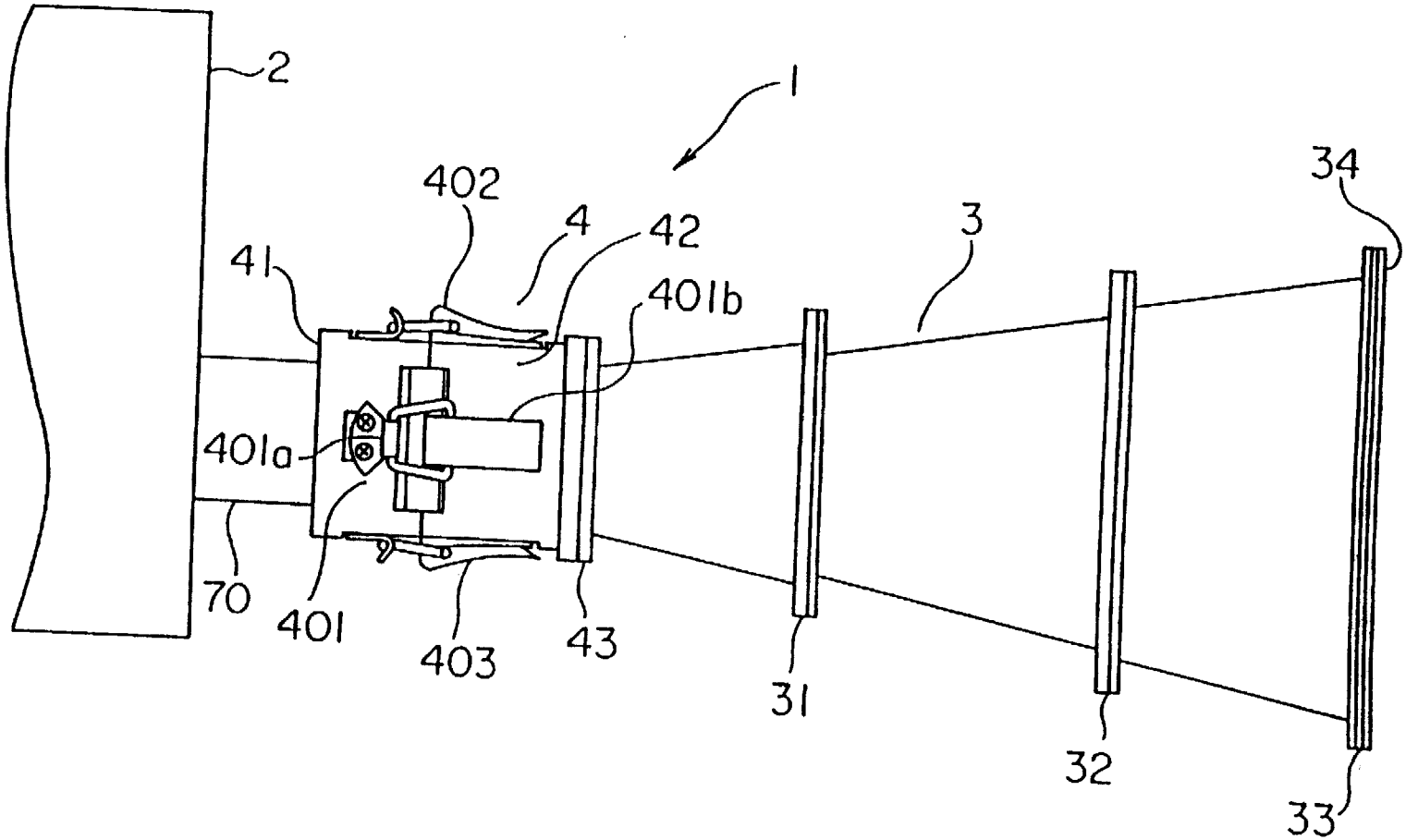
FIG. 1 is a view showing the configuration of a portable communication device of the present invention.

FIG. 1 is a view showing the configuration of a portable communication device of the present invention. As shown in the figure, the portable communication device 1 comprises a transmitter-receiver 2 for transmitting and receiving radio waves, a horn antenna 3 for receiving radio waves from a communications satellite and for sending radio waves to the communication satellite, and a connecting portion 4 provided between the transmitter-receiver 2 and the horn antenna 3.

A waveguide forming portion 70 extends from the transmitter-receiver 2, and a flange 41 of the connecting portion 4 on the transmitter-receiver side is fixed to the tip end of the waveguide forming portion 70.

The horn antenna 3 is formed so as to spread toward its tip end, and two reinforcing frames 31 and 32 are installed between the base and tip of the horn antenna to ensure the strength of the entirety of the horn antenna 3. The base of the horn antenna 3 is fixed to the flange 42 of the connecting portion 4 on the horn antenna side via the attaching flange 43. The end opening portion of the horn antenna 3, which is formed by an external frame 33, is covered by a feedome 34 formed of flow glass.

The connecting portion 4 comprises the aforementioned two flanges: the flange 41 on the transmitter-receiver side and the flange 42 on the horn antenna side. Between these two flanges are provided clasps 401, 402, and 403 and another clasp not shown. These four clasps 401 etc. are arranged at equal intervals around the outer periphery of the interface of the connecting portion 4. The clasp 401 comprises a fixing hook portion 401*a* and a pushing-down portion 401*b*. The fixing hook portion 401*a* and the pushing-down portion 401*b* are fixed to the flange 41 on the transmitter-receiver side and the flange 42 on the horn antenna side, respectively. Other clasps 402 etc. have the same configuration as that of the clasp 401, so that the description thereof is omitted.

Next, the internal construction of the above-described portable communication device will be described.

Figure 2:
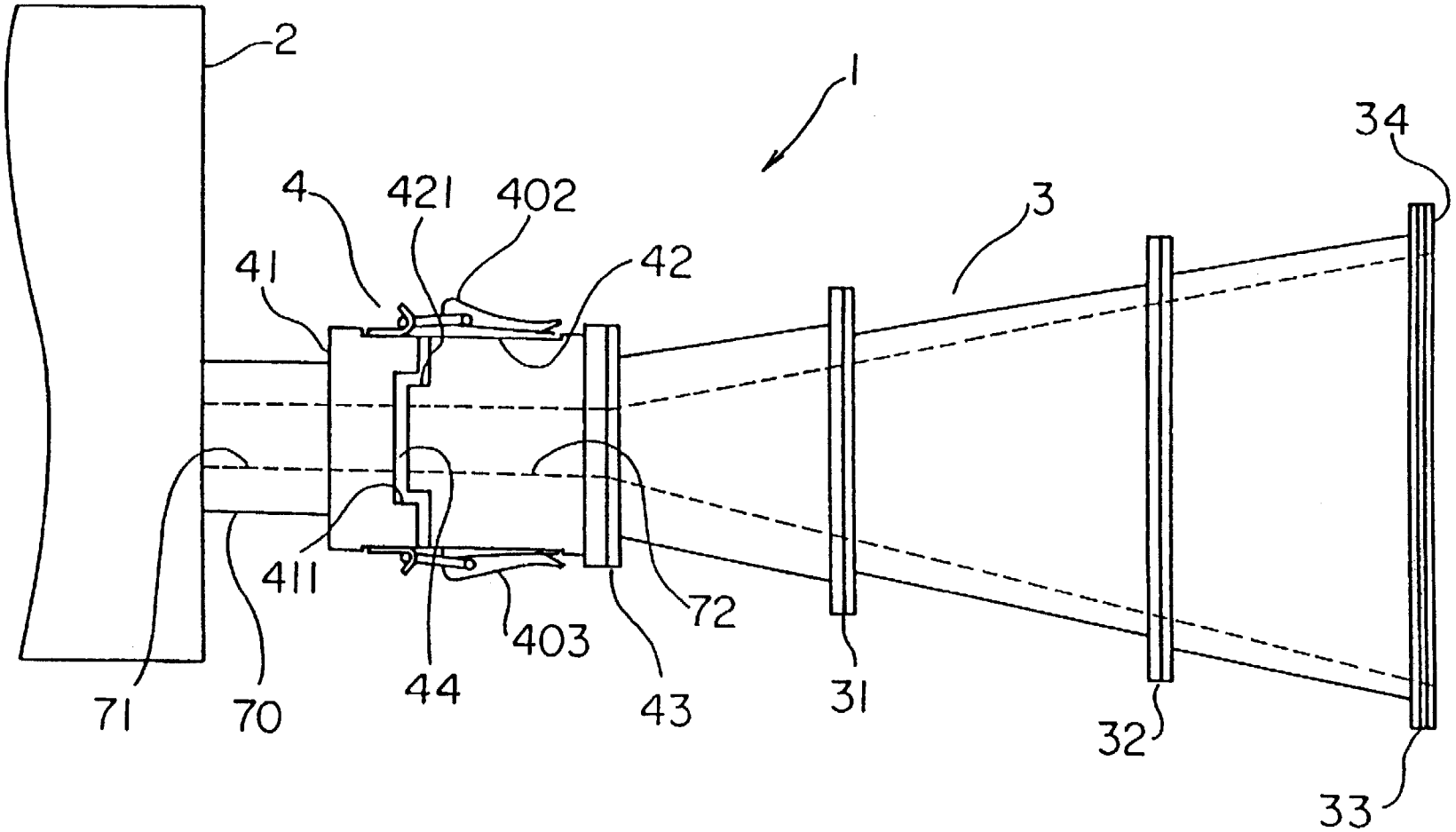
FIG. 2 is a view schematically showing the internal construction of the portable communication device.

FIG. 2 is a view schematically showing the internal construction of the portable communication device. In the figure, waveguides 71 and 72 are provided in the flange 41 on the transmitter-receiver side and the flange 42 on the horn antenna side of the connecting portion 4, respectively, so that the waveguides 71 and 72 are connected integrally via a gap portion 44, described in detail later, when the flanges 41 and 42 are connected to each other. The waveguide 71 is provided so as to extend through both the waveguide forming portion 70 and the flange 41 on the transmitter-receiver side, and its one end is connected to the transmitter-receiver 2.

The flange 41 on the transmitter-receiver side has an interface concave portion 411 formed on its interface, whereas the flange 42 on the horn antenna side has an interface convex portion 421 formed on its interface. The interface concave portion 411 and the interface convex portion 421 are fitted in a not-contacting condition via the gap portion 44 when the flanges 41 and 42 are connected to each other. The reason why the gap portion 44 is provided between the interface concave portion 411 and the interface convex portion 421 is that in case that the gap portion 44 is not provided, the interface convex portion 421 is fitted to the interface concave portion 411 in contact with each other when the flanges 41 and 42 are connected to each other, and the contacting portion is damaged each time the interface convex portion 421 is brought into contact with the interface concave portion 411, the waveguides 71 and 72 being sometimes affected by the damage. In this embodiment, such damage can be prevented by providing the gap portion 44.

In the portable communication device 1 having the aforementioned configuration, the flange 42 on the horn antenna side is connected to the flange 41 on the transmitter-receiver side with four clasps 401 etc. The clasps 401 etc. can be operated very easily with a single motion. Therefore, the horn antenna 3 can be attached to and detached from the transmitter-receiver 2 in a short time without a tool. Also, this attaching/detaching operation can reliably be performed in the dark without lighting.

When the clasps are used for connection, the connecting accuracy is slightly low because it depends on the accuracy of clasps themselves. Therefore, misalignment may occur between the waveguide 71 on the transmitter-receiver side and the waveguide 72 on the horn antenna side. If radio waves are sent to the communication party with such misalignment being left, the communication party must make fine adjustments according to the radio wave; it is difficult for the party to receive the radio waves. Therefore, there must be no misalignment between the waveguides 71 and 72 at the connecting portion 4. The methods for correcting the misalignment in connection will be described below.

Figure 3:
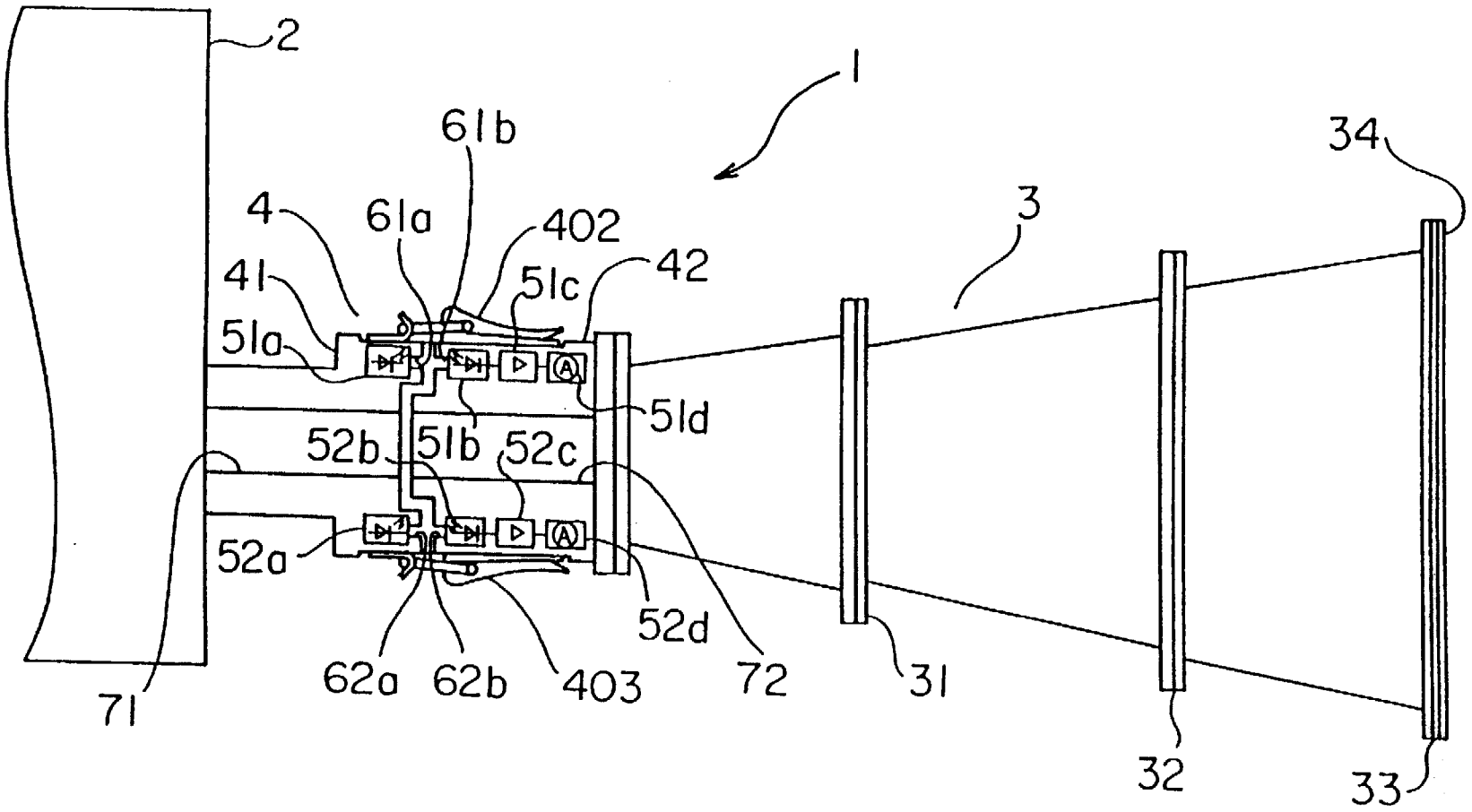
FIG. 3 is a view for illustrating a first example for correcting misalignment in connection.
Figure 4A:
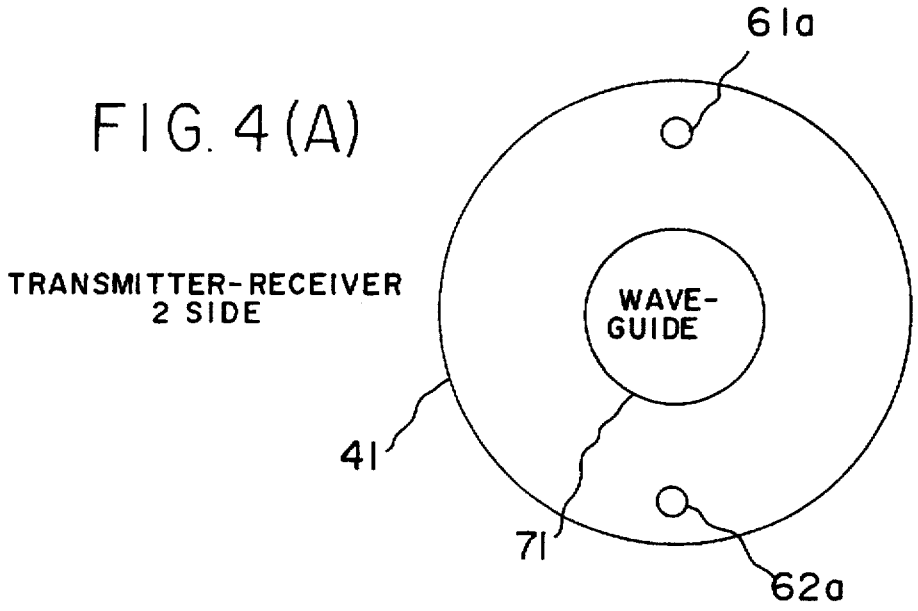
FIGS. 4(A) and 4(B) are sectional views of interfaces of connecting portion.
Figure 4B:
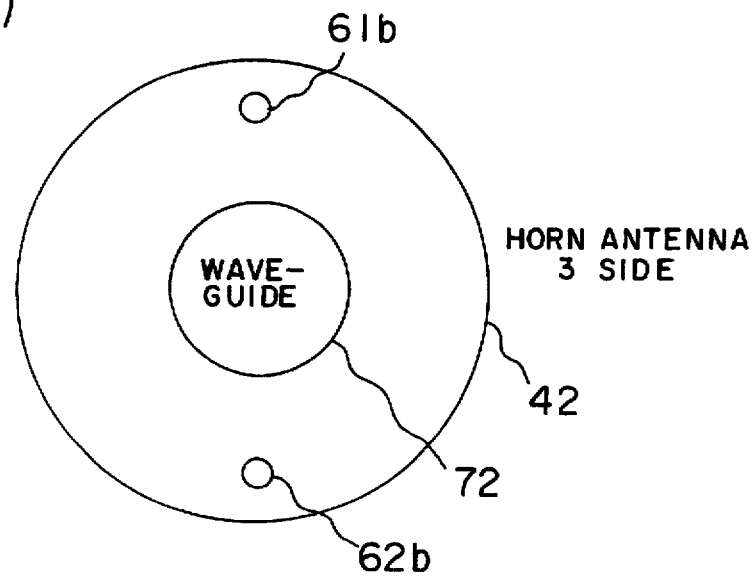

FIG. 3 is a view for illustrating a first example for correcting misalignment in connection. This first example shows a method to detect misalignment with light. In the figure, light transmission holes 61*a* and 62*a* are provided on the interface side of the transmitter-receiver flange 41. Likewise, light transmission holes 61*b* and 62*b* are provided on the interface side of the horn antenna flange 42 at positions where they align with the aforementioned light transmission holes 61*a* and 62*a*, respectively, when the flanges 41 and 42 are connected. These holes are positioned on one straight line at both sides of the waveguides 71 and 72 as shown in the sectional views of FIGS. 4(A) and 4(B). Inside the transmitter-receiver flange 41, LED's 51*a* and 52*a* are installed at the bottom of the light transmission holes 61*a* and 62*a*, respectively. Inside the horn antenna flange 42, a photo coupler 51*b*, an amplifier 51*c*, and a current detector 51*d* are installed in that order at the bottom of the light transmission hole 61*b*. Likewise, a photo coupler 52*b*, an amplifier 52*c*, and a current detector 52*d* are installed in that order at the bottom of the light transmission hole 62*b*.

With the connecting portion 4 of such a construction, the light emitted from the LED 51*a* is detected by the photo coupler 51*b* and converted to a current corresponding to the quantity of light, the current being detected by the current detector 51*d* via the amplifier 51*c*. The light emitted from the LED 52*a* is likewise detected by the current detector 52*d*.

When the transmitter-receiver flange 41 and the horn antenna flange 42 are connected to each other without misalignment, the LED's 51*a* and 52*a* completely face the photo couplers 51*b* and 52*b*, respectively. Therefore, the photo couplers 51*b* and 52*b* detect the whole quantity of light emitted from the LED's 51*a* and 52*a*; as a result, the current values detected by the current detectors 51*d* and 52*d* become the maximum. When the transmitter-receiver flange 41 and the horn antenna flange 42 are connected to each other with misalignment, part of the light emitted from the LED's 51*a* and 52*a* is interrupted by the interface. For this reason, the current values detected by the current detectors 51*d* and 52*d* do not become the maximum, and a low current is indicated. Therefore, the current detectors 51*d* and 52*d* should be monitored when the flanges 41 and 42 are connected, and the positions of the flanges 41 and 42 should be adjusted so that the detected current values become the maximum.

If misalignment which is larger than the diameter of the light transmission holes 61*a* etc. occurs, the light does not enter the photo coupler. Therefore, the misalignment can be kept below a certain value by determining the hole diameter from the tolerance of misalignment.

Figure 5:
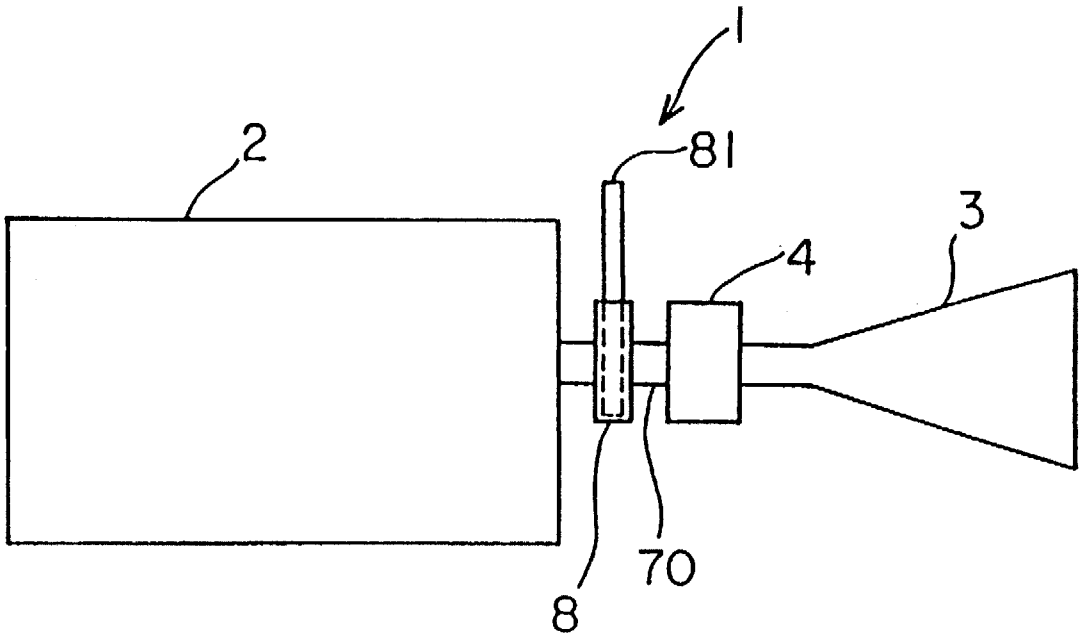
FIG. 5 is a view for illustrating a second example for correcting misalignment in connection.
Figure 6:
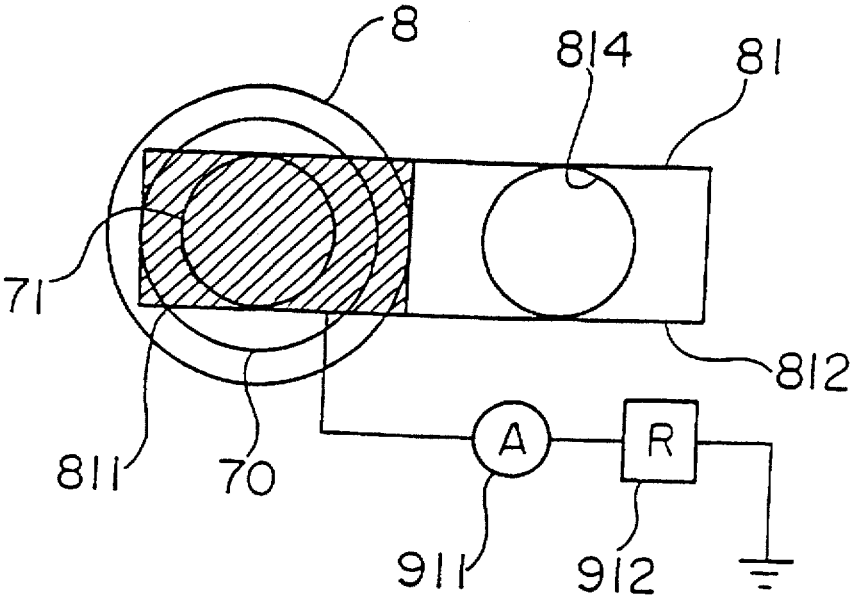
FIG. 6 is a sectional view of a slit inserting portion.

FIG. 5 is a view for illustrating a second example for correcting misalignment in connection. This second example also provides a method in which misalignment is detected with light like the aforementioned first example. In this example, the light is received by a solar battery. In the figure, a slit inserting portion 8 is provided on the waveguide forming portion 70 of the connecting portion 4, and a slit 81 is inserted in the slit inserting portion 8. The slit 81 comprises a solar battery portion 811 and a cavity portion 812 as shown in FIG. 6. To the solar battery portion 811 are connected a current detector 911 for detecting the current produced at the solar battery portion 811 and a resistor 912 for properly adjusting the current value.

To detect misalignment, the solar battery portion 811 of the slit 81 is inserted in the slit inserting portion 8. At this time, the whole section of the waveguide 71 in the waveguide forming portion 70 is covered by the solar battery portion 811. In this condition, the horn antenna 3 is fixed so as to face a light source such as the sun or a room light, and the reading of the current detector 911 is monitored. When the reading of the current detector 911 becomes the maximum, there is no misalignment at the connecting portion 4. Therefore, the misalignment of the connecting portion 4 should be adjusted so that the reading of the current detector 911 becomes the maximum.

When the adjustment of misalignment is completed, the slit 81 is further pushed into the slit inserting portion 8 so that the hole 814 of the cavity portion 812 is positioned at the waveguide 71, and the portable communication device 1 is used in this condition.

Figure 7:
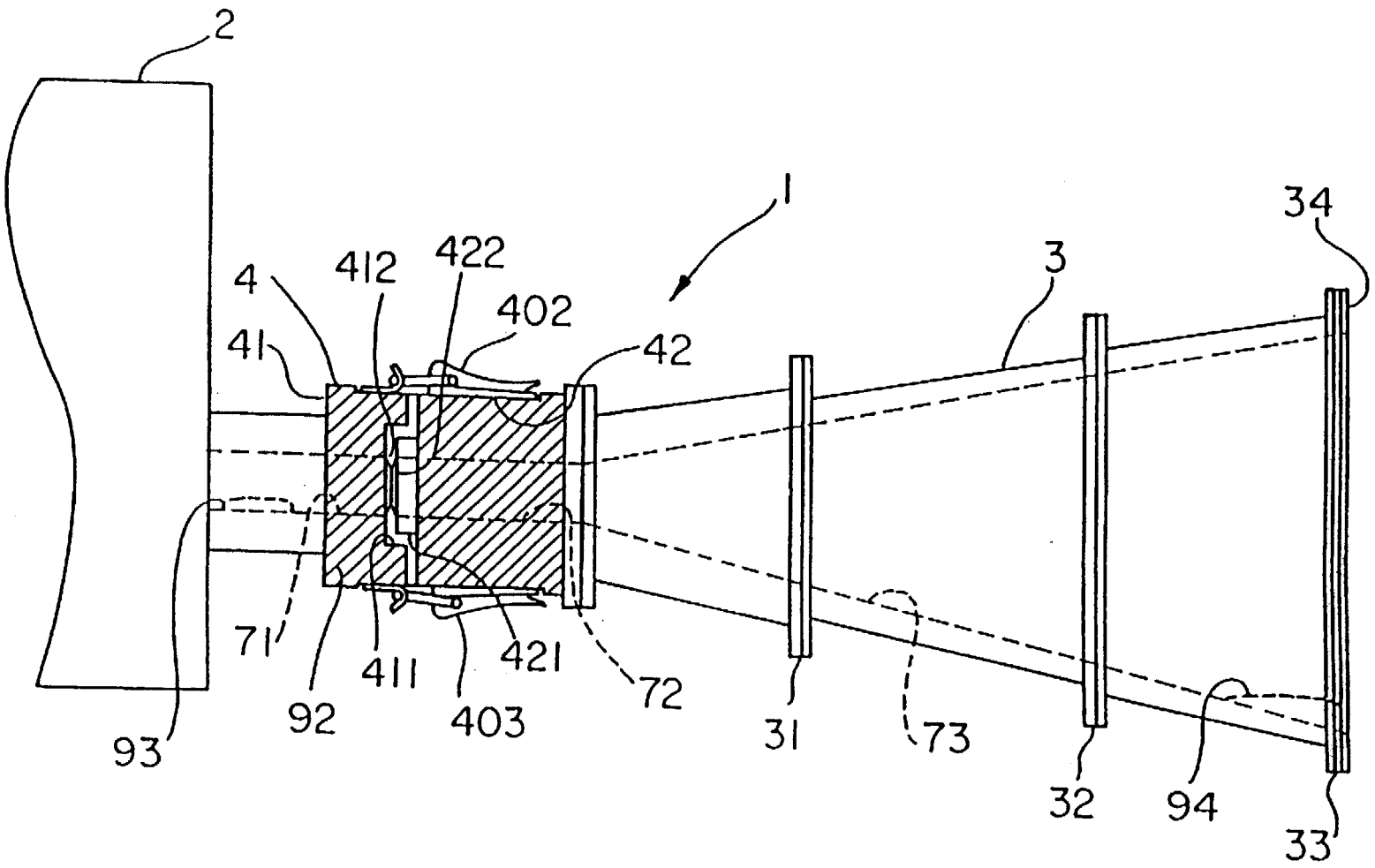
FIG. 7 is a view showing a second embodiment of the present invention.

FIG. 7 is a view showing a second embodiment of the present invention. This embodiment differs from the first embodiment shown in FIGS. 1 and 2 in that a window is provided on each surface of the interface concave portion 411 and the interface convex portion 421 of the connecting portion 4 to form airtight windows 412 and 422 by attaching a flow glass film to the window, and the connecting portion 4 is covered by a plate-shaped heater 92. In addition, liquid storage portions 93 and 94 are provided in the waveguide 71 and the horn antenna 3, respectively. The liquid storage portions 93 and 94 contain a substance which is easy to evaporate, has a high degree of pressure increase with the increase in temperature, and does not affect the transmitted and received signals, such as ethyl alcohol or ether.

With the portable communication device 1 of such a configuration, when the plate-shaped heater 92 is heated, the air in the transmitter-receiver 2 and the air in the horn antenna 3 are warmed and expanded. In addition, the interior of the transmitter-receiver 2 is airtightly closed by the airtight window 412, while the interior of the horn antenna 3 by the airtight window 422 and the feedome 34. Therefore, humid air from the outside cannot enter the interior of the transmitter-receiver 2 and the interior of the horn antenna 3, so that airtightness is reliably maintained.

Further, when the air inside the transmitter-receiver and the horn antenna is warmed, the heat of the air evaporates the liquid in the liquid storage portions 93 and 94, so that the inside air pressure is further increased, which further maintains the airtightness.

Although the second embodiment has been applied to a portable communication device in which connection is made with clasps in the above description, the second embodiment can be applied to all types of portable communication devices regardless of the method for connection.

With the aforementioned portable communication device 1, when transmission is carried out with no horn antenna being connected, the transmitted signal is reflected by the open connecting portion 4 and returned to the transmitter, which will destroy the transistor of the final stage amplifier in the transmitter. In order to prevent such a failure, it is essential to surely know whether the horn antenna 3 is connected or not. The method for detecting the connection of horn antenna 3 will be described below.

Figure 8:
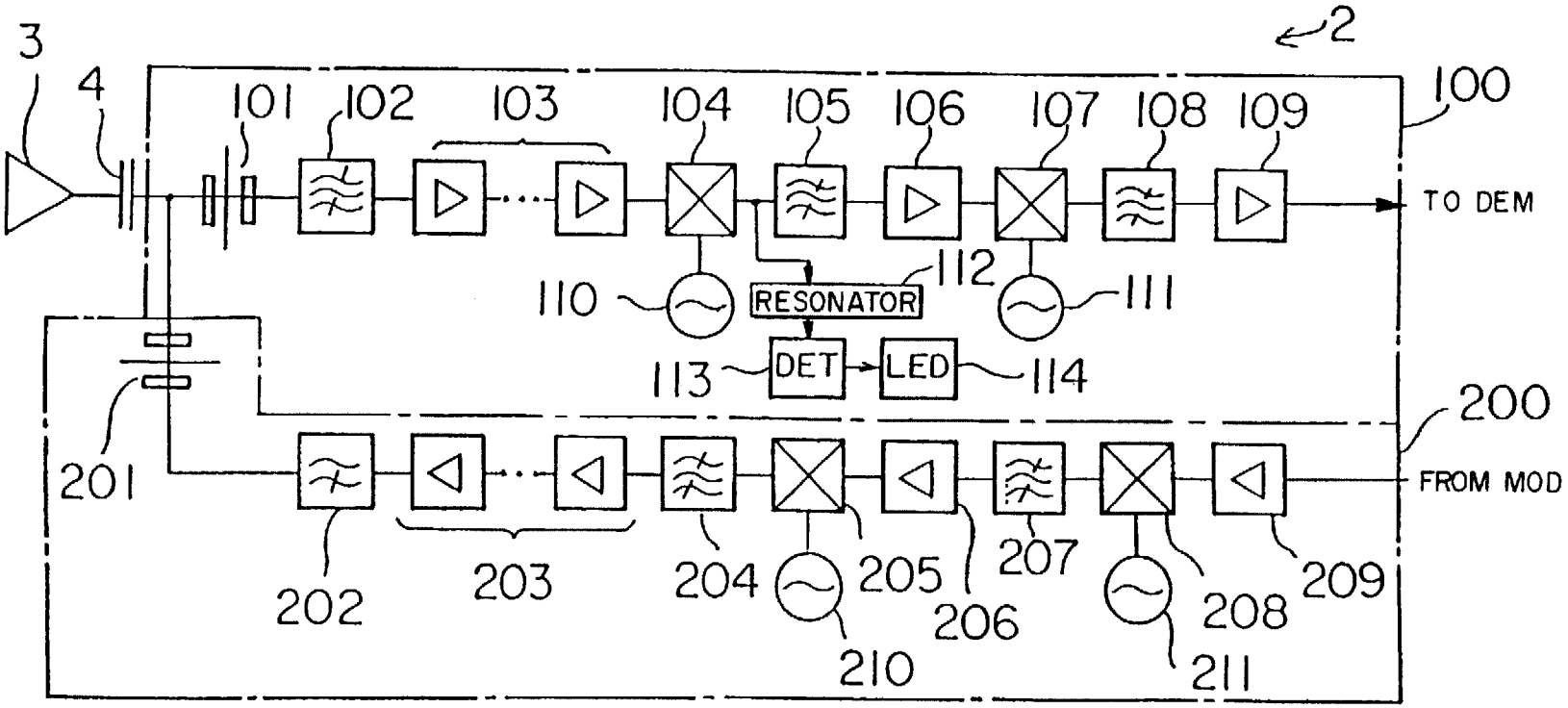
FIG. 8 is a view showing a circuit for a transmitter-receiver and a circuit for detecting the connection of horn antenna in the portable communication device.

FIG. 8 is a view showing a circuit for a transmitter-receiver and a circuit for detecting the connection of horn antenna in the portable communication device. In the figure, the transmitter-receiver 2 comprises a receiver 100 and a transmitter 200. The radio waves received by the horn antenna 3 enter the receiver 100 of the transmitter-receiver 2 through the waveguide in the connecting portion 4. The radio waves entering the receiver 100 pass through an OMT (Orth Mode Transducer) 101. After that, a frequency component of 12 GHz is taken out by a band pass filter 102. Then, the frequency component is converted to an electric signal, which is amplified by a plurality of (for example, three) low noise amplifiers (LNA's) 103, and enters a frequency converter (mixer) 104. The 12 GHz electric signal entering the frequency converter 104 is converted to an electric signal having a 1 GHz frequency component in accordance with the electric signal from a local oscillator 110, and enters a frequency converter 107 through a band pass filter 105 and an intermediate frequency amplifier 106. The 1 GHz electric signal entering the frequency converter 107 is converted to a 70 MHz intermediate frequency electric signal (IF signal) in accordance with the electric signal from a local oscillator 111, and outputted from the receiver 100 to a demodulator (DEM) after passing through a band pass filter 108 and an intermediate frequency amplifier 109.

In the transmitter 200, an intermediate frequency amplifier 209 amplifies an IF signal of 70 MHz sent from a modulator (MOD). The IF signal enters a frequency converter 208, where the IF signal is converted to a 1 GHz electric signal in accordance with the electric signal from a local oscillator 211. Then, the 1 GHz electric signal enters a frequency converter 205 through a band pass filter 207 and an intermediate frequency amplifier 206. The 1 GHz electric signal entering the frequency converter 205 is converted to a 14 GHz electric signal in accordance with the electric signal from a local oscillator 210. The 14 GHz electric signal passes through a band pass filter 204 and a plurality of (for example, five) high-output amplifier 203, is converted to a radio wave signal, and passes through a high pass filter 202. The radio wave signal further passes through the OMT 201 and the waveguide in the connecting portion 4, and transmitted from the horn antenna 3 toward the communications satellite.

With the transmitter-receiver 2 having such a circuit configuration, a cavity resonator 112, which functions as a band pass filter, is connected between the frequency converter 104 and the band pass filter 105 in the receiver 100. To the cavity resonator 112, a signal level detector 113 and an LED 114 are connected in series.

A leak signal with frequency $f_{LO}$ is generated from the local oscillator 110 of the receiver 100 toward the horn antenna 3. When the horn antenna 3 is connected to the connecting portion 4, the leak signal is radiated from the horn antenna 3 to the outside, and does not return to the receiver 100. When the horn antenna 3 is not connected to the connecting portion 4, the leak signal is reflected by the open connecting portion 4 and returns to the receiver 100. Its frequency is changed by the frequency converter 104, and the signal turns to $2f_{LO}$ signal having a double frequency of $2\times f_{LO}$. The aforementioned cavity resonator 112, which is connected to the following stage of the frequency converter 104, takes out the $2f_{LO}$ signal and sends it to a signal level detector 113. The signal level detector 113 detects the $2f_{LO}$ signal and lights an LED 114. The operator of the portable communication device 1 who looks at the lit LED 114 can find that the horn antenna 3 is not connected to the connecting portion 4. Therefore, a failure which may occur when a signal is transmitted without horn antenna 3 being connected can be prevented.

Figure 9:
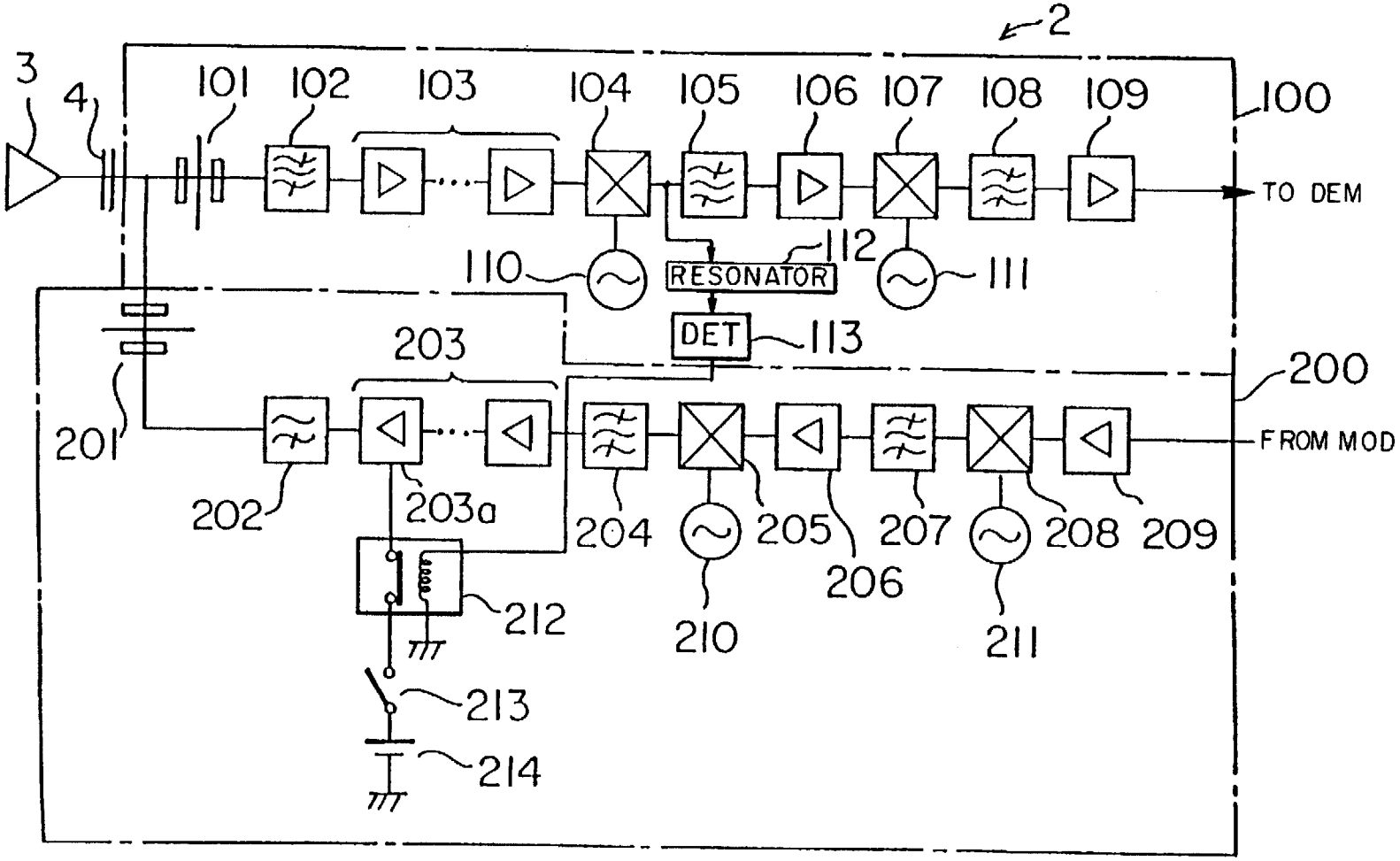
FIG. 9 is a view showing a second example of the circuit for detecting the connection of horn antenna.

FIG. 9 is a view showing a second example of the circuit for detecting the connection of horn antenna. The second example differs from the aforementioned first example in that a relay switch 212 is provided between a high-output amplifier 203*a*, which is the final stage amplifier of the transmitter 200, and a power supply switch 213 for the high-output amplifier 203*a* so that the relay switch 212 is actuated by the detection signal from the aforementioned signal level detector 113.

As described above, the leak signal outputted from the local oscillator 110 of the receiver 100 is reflected by the open connecting portion 4, turning to $2f_{LO}$ signal having a frequency of $2\times f_{LO}$. The aforementioned cavity resonator 112, which is connected to the following stage of the frequency converter 104, takes out the $2f_{LO}$ signal and outputs it to the signal level detector 113, which detects the $2f_{LO}$ signal and outputs it to the relay switch 212. The relay switch 212 operates upon receipt of the detection signal from the signal level detector 113, and shuts off the power voltage from a power supply 214, which is applied to the high-output amplifier 203*a*.

Thus, when the horn antenna 3 is not connected, the power voltage of the high-output amplifier 203*a* is forcedly shut off. As a result, the transmission is reliably prevented even when the operator of the portable communication device 1 accidentally turns on the power of the transmitter 200 without horn antenna 3 being connected. Therefore, a failure of the transmitter 200 can be prevented more reliably.

Although the power voltage of the high-output amplifier 203*a* has been shut off by the detection signal from the signal level detector 113 in this second example, the power voltage of the transmitter 200 itself may be shut off.

The aforementioned circuit for detecting the connection of horn antenna can be applied not only portable communication devices in which connection is made with clasps but also all types of portable communication devices regardless of the method for connection.

Although the clasps 401 etc. have been installed around the interface of the connecting portion 4 in the above description, a plurality of screwed portions may be installed together with the clasps 401 etc. around the interface. By using the screwed portions together with the clasps to connect the horn antenna 3 to the transmitter-receiver 2, the connecting accuracy can be improved even when a sufficient connecting accuracy cannot be provided by the clasps 401 etc. only.

As described above, in the present invention, single-motion attaching/detaching means is provided at the connecting portion between the horn antenna and the transmitter-receiver. Therefore, the horn antenna can be attached to and detached from the transmitter-receiver in a short time without a tool. Also, this attaching/detaching operation can reliably be performed in the dark without lighting.

In the case of communication requiring urgency, therefore, the requirement can be met reliably.

Further, leak deflection signal detecting means for detecting the leak reflection signal is provided on the signal receiving circuit side in the transmitter-receiver. The leak reflection signal is a signal which is generated when the horn antenna is not mounted. By the detection of leak reflection signal, therefore, the operator of the portable communication device can find that the horn antenna is not connected to the connecting portion, which prevents a failure occurring when signals are transmitted with no horn antenna being mounted.

Still further, air heating means is provided at the connecting portion between the horn antenna and the transmitter-receiver to warm the air inside the horn antenna and the transmitter-receiver which maintain airtightness. Therefore, the inside air is warmed and expands, so that the humid air from the outside cannot enter the interior of the horn antenna and the interior of the transmitter-receiver, which prevents a failure caused by the entrance of moisture into the transmitter-receiver. Also, the portable communication device can be used in any climate conditions.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A portable communication device having a horn antenna and a transmitter-receiver which contains a signal transmitting circuit and a signal receiving circuit including a local oscillator, comprising:

a connecting portion provided between said horn antenna and said transmitter-receiver; and leak reflection signal detecting means provided in the signal receiving circuit, for detecting a leak reflection signal generated by a process in which a leak signal is generated from the local oscillator of said signal receiving circuit and transmitted toward said horn antenna, and then is reflected by said connecting portion when said horn antenna is not connected.

2. A portable communication device according to claim 1, wherein said leak reflection signal is a signal whose frequency is doubled in said signal receiving circuit.

3. A portable communication device according to claim 1, further comprising power interrupting means provided in the signal transmitting circuit, for shutting off power in said signal transmitting circuit when said leak reflection signal detecting means detects the leak reflection signal.

4. A receiving circuit for an antenna comprising:

a connecting portion for connecting an antenna to the receiving circuit;

a leak test signal generating circuit, generating a leak test signal and transmitting the generated leak test signal to said connecting portion; and a detecting circuit for detecting a reflection of the generated leak test signal, reflected from said connecting portion.

5. The receiving circuit of claim 4, wherein said detecting circuit comprises a resonator and a signal level detector.

6. The receiving circuit of claim 4, wherein said leak test signal generating circuit comprises an oscillator.

7. A communication device for sending and receiving signals through an antenna, comprising:

a transceiver, including a transmitter for transmitting signals and a receiver for receiving signals; and a connecting portion for connecting the antenna to said transceiver;

wherein said receiver includes a leak test signal generating circuit, generating a leak test signal and transmitting the generated leak test signal to said connecting portion; and a detecting circuit for detecting a reflection of the generated leak test signal, reflected from said connecting portion.

8. The communication device of claim 7, wherein said detecting circuit comprises a resonator and signal level detector.

9. The communication device of claim 7, wherein said leak test signal generating circuit comprises an oscillator.

10. The communication device of claim 7, further comprising:

a horn antenna, attachable and detachable to said transceiver through said connecting portion.

* * * * *